United States Patent [19]

Heraty

[11] 4,037,700

[45] July 26, 1977

[54] COIN VAULT

[76] Inventor: Patrick T. Heraty, 3785 Columbus, Chicago, Ill. 60652

[21] Appl. No.: 691,598

[22] Filed: June 1, 1976

[51] Int. Cl.[2] ..... G07F 9/06

[52] U.S. Cl. ..... 194/1 B; 232/15

[58] Field of Search ..... 194/1 B, 1 A, 1 R, DIG. 21, 194/DIG. 22, 10, 13; 232/15, 16

[56] References Cited

U.S. PATENT DOCUMENTS

| | | | |
|---|---|---|---|
| 3,127,097 | 3/1964 | O'Brien et al. | 232/15 X |
| 3,353,743 | 11/1967 | Amundsen | 232/15 |

*Primary Examiner*—Stanley H. Tollberg
*Attorney, Agent, or Firm*—Dominik, Knechtel, Godula & Demeur

[57] ABSTRACT

A hollow post vault for a coin box which receives coins along a chute joined to a coin mechanism at the top of the post, said coin mechanism operating an appliance such as a vacuum machine in a car wash service station. The coin box is placed inside and withdrawn from the post through a bottom port which requires a user to execute a bottom-up movement to reach the coin box which is held above the port by a releasable support member. The support member is locked inside the post, and such lock is released by first executing said bottom-up movement so that the support member may be withdrawn and the coin box removed through the bottom port. In a further feature, the coin box has an automatic closure which operates to seal a top opening after separating the box from a coin chute.

15 Claims, 12 Drawing Figures

COIN VAULT

THE INVENTION AND BACKGROUND

This invention relates to a coin vault assembly, particularly an assembly used with a coin operated device whereby a coin box is secured against theft.

Security considerations are always present with various coin operated devices. Particular attention is directed to the coin receiving location, be it a chamber or a removable box. The security considerations are understandably far greater with mechanisms that are not located within buildings, that is, vending mechanisms located outside such buildings to which thieves have ready and easy access.

The art has disclosed various approaches to securing coin locations of vending machines, and representative approaches for machines within building structures may be seen in U.S. Pat. No. 3,166,174 and U.S. Pat. No. 3,390,753. A common outdoor coin operated mechanism is a parking meter, and coin boxes have been secured within housing parts which are opened by lock and key, such as shown in the U.S. Pat. No. 2,483,805. The problem with such approaches is that the lock and key assembly is exposed to exterior tampering or forcing actions. In many such approaches, the coin location is behind an openable door or panel secured by a lock mechanism. The thief is provided with an easy area of access for forcing the openable door or panel or for picking the lock.

OBJECTS AND ADVANTAGES OF THE INVENTION

It is an object of the present invention to provide a coin vault assembly in which a coin box is secured by the principal provision of preventing a thief from attaining easy access to the secured location. This object is served by requiring a prospective thief to assume a most awkward attack position and thereby seriously handicap freedom of access and action, thus increasing the obstacles to successful break in.

Another object is a coin vault assembly which provides improved security in various locations, but particularly outdoors where opportunity favors the thief. In particular, the important factor of viewability is taken away from the would be thief, requiring the thief to grope in unseeing relationship relative to the coin box location.

Yet still another object of the invention is a secured coin vault for a coin operated device which can be located in places having outside traffic access, and which coin vault secures a coin box inside an impregnable heavy duty steel post to prevent viewing of the coin box and to allow only awkward bottom-up manual access with a highly limited zone of movement for the hands. Particularly, a bottom post opening is provided so that a user must snake his hands upwardly into the post to release a locking member and allow withdrawal of the support which holds the coin box.

It is yet another object of the present invention to provide a secured coin vault of the type described which utilizes, in one form, a support member positionable from the outside and locked in place from inside the post, with provisions to prevent or greatly discourage attempts to withdraw or to break the support from outside the post. This object is served by providing a support member of heavy duty steel in which only a handle part is exposed on the exterior of the post, and which requires intense and prolonged efforts to sever the handle and break away the support holding the coin box. Alternatively, the lock and support member may be advantageously located entirely within the post.

Still another object is the provision of a secured coin vault of the type described in which a coin box is provided with automatic closure means that seal off a top opening after the locked support member is released and the coin box is dropped and separated from the coin chute leading to the coin mechanism at the top of the post.

A yet still another object is the provision of an improved coin vault which is separated from the coin operated device to thereby clearly report the presence of coins separated from the coin operated mechanism and thereby protect such mechanism from damaging attacks.

DESCRIPTION OF THE VIEWS OF THE DRAWINGS

The foregoing objects are now attained by the present invention, as well as other objects and advantages which will be apparent when practitioners consider the disclosure of the invention shown in the enclosed drawings wherein.

SUMMARY OF THE INVENTION

Figure 1:
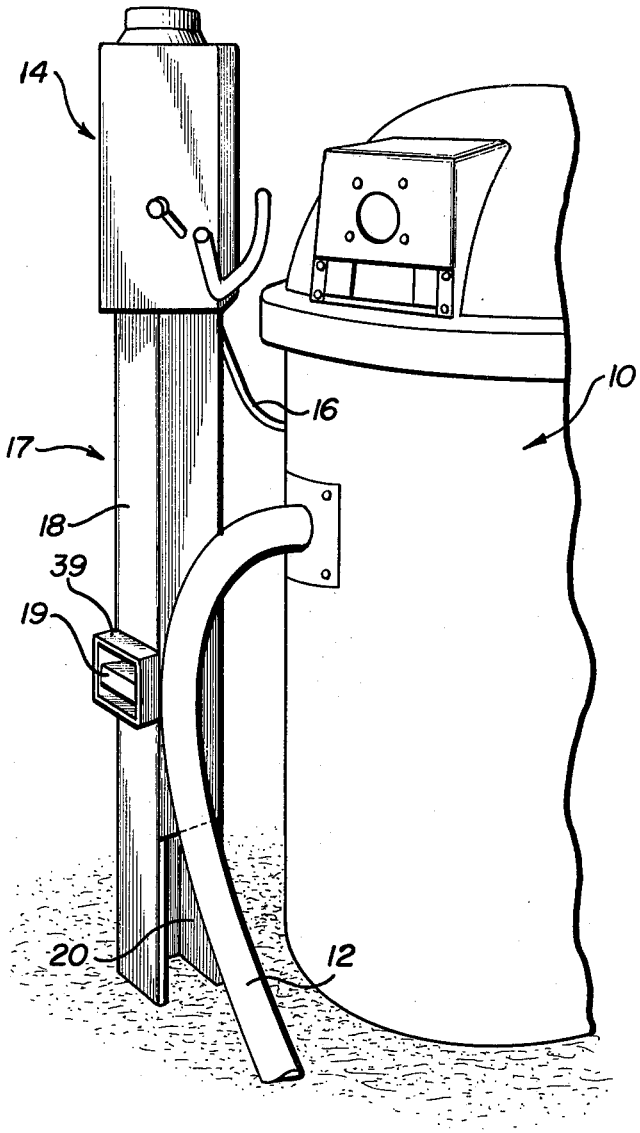
FIG. 1 is a perspective view, with parts removed, showing the coin vault assembly connected to a typical appliance.
Figure 2:
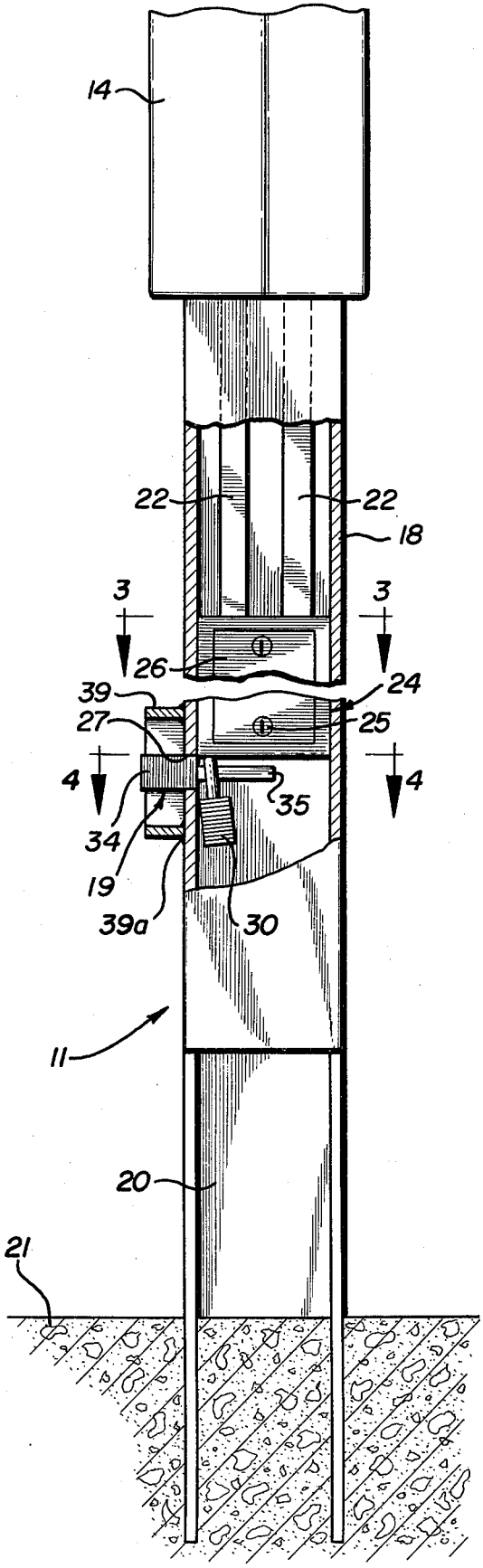
FIG. 2 is a side elevational view of the coin vault assembly, on an enlarged scale, with parts removed and parts in section.
Figure 3:
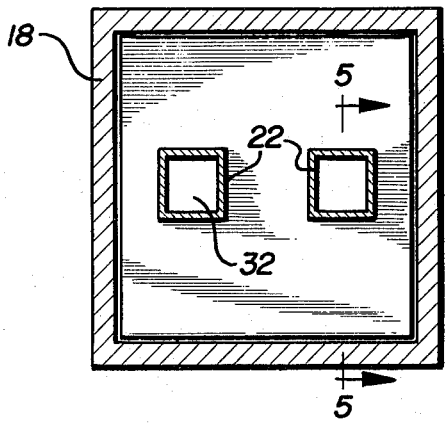
FIG. 3 is a sectional view taken along line 3—3 of FIG. 2, on an enlarged scale.

A coin vault is provided in which a coin box is removably held inside a rugged hollow post, the coin mechanism being at the top of the post and a coin chute conveying the coins from the mechanism to the coin box. The bottom of the post has an open port, and the user must squat or kneel so that the hands can move through the port and snake upwardly to release a lock which holds a support member on which the coin box freely rests. The port may be any opening in a sidewall of a post anchored at ground level, or it may be the open bottom of a post anchored above ground level. A key lock may be provided which is unlocked by "feel"to disengage a support member so the box may be dropped into the waiting hands of the user. The locking action, on the other hand, engages the support member to hold the box.

The support member engages one or more mounting bores in one or more sidewalls of the post. The support member may have a heavy duty handle outside the post and an elongated blade which extends inside the post. The handle has substantial mass and is formed from a dense and hard metal, such as steel, so that the supposed thief would be discouraged from severing the handle, as with a hacksaw. The handle may be fenced in on the outside of the post to further discourage a cutting action along a plane which is generally parallel to a sidewall of the post. The placement of the blade portion inside the post is above the port and it neither can be seen nor be easily reached by the thief. While the blade portion has substantially less mass than the handle, it would be too awkward for the thief to manipulate a hacksaw, chisel, or jimmy tool. Effectively, interior severance or capture of the coin box is highly unlikely. Attempts to attack the mass of the handle portion would require so much time and effort that exterior severance and capture of the coin box is likewise highly unlikely.

In preferred practice, the handle portion is a polyhedral so that said handle is oriented in non-rotational position in a matching mounting aperture in a sidewall of the hollow post. This further encumbers any attempts to remove the support member from the outside of the post. In a still particular preferred embodiment, the handle member is provided with tapered sidewalls so that the handle is wedgingly fitted in a mounting aperture, thereby preventing withdrawal and exposure of the blade portion which has substantially less mass and would present an easier target for severance or rupture by the thief.

The support and locking members are alternatively mounted to the bottom of the coin box so that locking action moves support members to engage locking slots or recesses on the inside sidewalls of the post. Unlocking action disengages such support members so the box can be removed through the port.

A coin box may also be provided with a closure member which automatically seals off a top opening that normally receives a coin chute extending from an outward coin mechanism. In the illustrated form, the closure member is urged against the coin chute which extends inside the coin box so that dropping the coin box and separating it from the coin chute allows the closure member to be urged into sealing relationship with the open top in the box. The closure member engages a stop member which is provided with a biased locking element so that the closure member cannot be displaced to obtain access to the contents of the coin box. This is a precaution used with authorized collectors of the coin box, such as employees.

The collected coin box is conventionally opened by a door provided with a lock and key assembly and the closure member may be reset with the aid of a latch mechanism that holds the closure member against a compressed spring. Repositioning the coin box in the vault releases such latch mechanism when the coin chute enters a top opening and trips a latch element. The urging means then force the closure against the coin chute until the coin box is again removed.

DETAILED DESCRIPTION OF THE INVENTION

Looking at FIG. 1, there is seen a coin operated device such as an appliance, shown as a vacuum cannister 10. A vacuum hose 12 is indicated portionally, and further features of the appliance will not be described since the appliance does not form a part of the invention as such. The appliance is actuated in a programmed manner by a coin operated mechanism shown generally as 14, and this coin operated mechanism is connected to the appliance by an electrical conductor 16. Again, details of the coin operated mechanism relative to its programmed operations with the appliance shall not be further described because no particular features are essential to the invention which will be disclosed and claimed.

The coin operated mechanism 14 is shown mounted at the top of a coin vault assembly shown generally as 17. Such coin vault assembly, in part, comprises a tubular or hollow post 18 which has continuous sidewalls and which is of a very heavy duty construction such as welded steel plates. This makes it unlikely that the interior of the steel post will be invaded by attacks against the construction of the post. Other features of the vault assembly include a removable support member shown generally as 19, mounted to a sidewall of the post, and a bottom port 20 which serves as an egress and ingress for the user's hands. A port is shown in the configuration of a rectangular cutout in one sidewall of the post which has substantially square cross section. The cutout extends to the bottom edges of the post sidewalls, and such post is firmly and securely anchored to a ground support shown, in part, as a concrete base 21.

A pair of coin chutes 22 are shown extending from the coin operated mechanism 14 to a coin box 24, all inside the post 18. The coin box is shown as a polyhedral with a top, a bottom and continuous sidewalls. The illustrated side of the coin box is shown as having a key lock assembly 25 which opens a door 26 so that the coin contents in the box may be removed. Coins are deposited in the box when inserted in the coin mechanism, and drop through the coin chutes 22, which may be tubular conduits, rectangular and of low profile.

The support member 19 passing through a mounting aperture 27 in the sidewall of the post. A locking member, shown as a padlock 30 prevents the support member from being undesirably withdrawn. The support member holds the coin box 24 in position relative to the coin chutes 22 so that the coin chutes pass through top openings or coin entries 32 in the coin box. The coin chutes freely pass through the coin entries 32 so that removal of the padlock 30 and withdrawal of the support member 19 allows the coin box 24 to be freely dropped and separated from the coin chutes. The coin box is preferably held in position by the support member at a distance above the port so as to require a user to insert substantially all of his forearm before reaching the bottom of the coin box. This necessitates awkwardness in attack for a thief.

Figure 4:
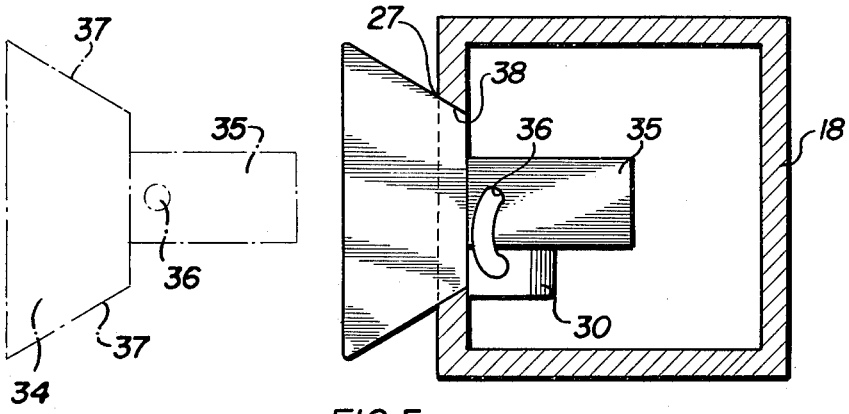
FIG. 4 is another sectional view taken along line 4—4 in FIG. 2, with a handle support member shown in phantom in withdrawn position.
Figure 5:
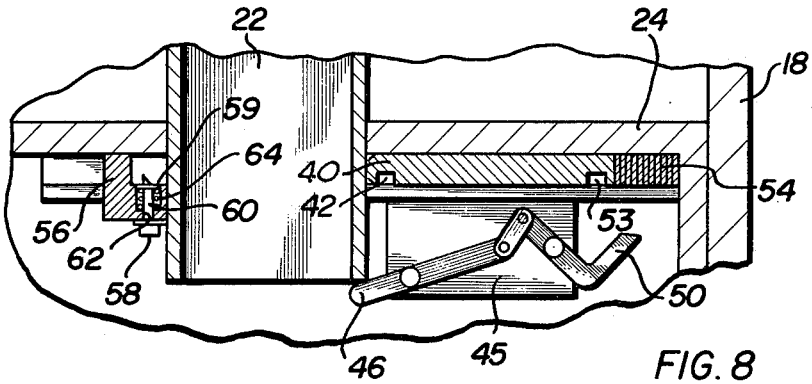
FIG. 5 is a sectional view, on an enlarged scale, taken along line 5—5 in FIG. 3.

Reference may be made to FIG. 4 to better understand the details of the support member. A handle 34 has an oversized portion relative to mounting aperture 27, and a blade portion 35 extends from the handle a sufficient distance to at least reach the longitudinal axis which symmetrically bisects the post. Such a length allows the support member to position the coin box securely, although the length of the blade is not in any sense critical, since the cross section of the box is similar to the cross section of the post to thereby prevent skewing. In other words, the shape of the box allows it to operate as a slide within the post. The blade has a locking passageway 36 to receive a locking member such as the shackle of the padlock 30. The handle 34 is provided with tapered sidewall portions 37 so that the handle may be wedgingly fitted in the mounting aperture 27, such aperture is provided with opposite side edges 38 that have a taper complementary to the sidewall tapers 37. The handle is shown surrounded by a steel fence 39 mounted by welds 39*a* to the sidewall of the post. The continuous fence prevents a thief from using a cutting tool on the handle along a plane which is generally parallel to the sidewall of the post.

The view of FIG. 4 particularly illustrates the position of the locking passageway 36 in the blade as being substantially closer to the handle 34 than to the terminating end of the blade. This allows placement of the padlock 30 so that the sidewall tapers 37 of the handle remain in wedging relationship in the mounting aperture 27. It is more important that the handle portion remain in the mounting aperture rather than having a tight wedging action, so the term "wedging relationship"is intended to particularly define the presence of a portion of the handle within the mounting aperture in non-withdrawal relationship. It is seen that the polyhedral configuration of the handle 34 is of irregular dimension so the handle may be more securely keyed in the mounting aperture. This prevents the thief from attempting to rotate and twist the support member to effect a rupture. Irregular dimensions likewise permit orientation of the handle in the mounting aperture for a more secure fit.

It is a feature of this invention that the coin box 24 is provided with closure means which seal off the coin entries 32 after removing the coin box. An embodiment illustrating such an automatic closure is shown in the views of FIGS. 5-9. Slidable coin entry closure member 40 is shown as having a locking catch 42 on its underside and adjacent one side of the closure. The closure member rides in spaced side angles or tracks 44. The vertical arms of such angles are fixed to the underside of the coin box top by means which are not shown but which are conventional. A pair of spaced and depending sidewalls 45 are secured to the bottom of side angles 44 by means not shown. The spaced sidewalls support a latch assembly or mechanism which includes a latch release element or bar 46 which rotates around pivot bracket 47 extending between the sidewalls 45. The latch element 46 has a free end which is in the path of a coin chute 32 and is tripped by said coin chute when inserting the box in place. The other end of the latch element 46 is joined to an H-link member 48 and said end is pivotally held between the lower legs of the H-link by pivot pin 49. A crank latch or bar 50 has an arm 50*a* which rotates around pivot bracket 51 which extends between sidewalls 45. The end of arm 50*a* is pivotally connected between the upper legs of the H-link 48 by a pivot pin 52. The free arm 50*b* of the latch element 50 operates as a detent to engage holding notch 53 in the closure member 40. The latch element 50 holds the closure member 40 against the urgings of spring 54.

Figure 6:
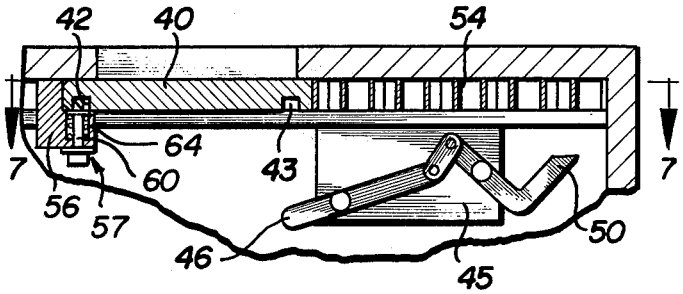
FIG. 6 is a view similar to that of FIG. 5, but showing the box with the closure member sealing off the top opening.
Figure 8:
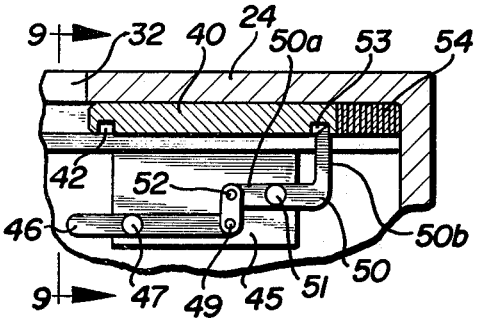
FIG. 8 is a view similar to that of FIG. 6, but with portions removed with the latch mechanism shown in closure retaining position.
Figure 7:
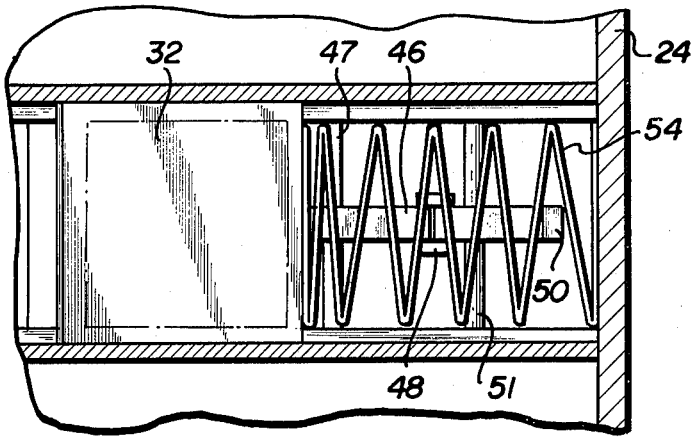
FIG. 7 is a sectional view taken along line 7—7 in FIG. 6.
Figure 9:
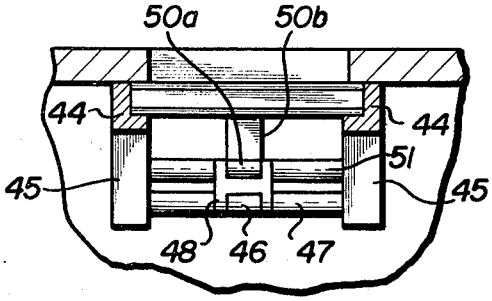
FIG. 9 is a sectional view taken along line 9—9 in FIG. 8.

The latch mechanism is set as shown in FIG. 8 to hold the closure member in non-sealing position against the means urging the closure member to sealing position. The latch assembly may be set by hand after the coin contents are removed from the box. Replacing the coin box in the tubular post results in releasing the latch mechanism when the coin chutes 22 pass through coin entries 32 and intercept the free end of the release latch element 46. The user moves the box upwardly until the chute 22 contacts release latch 46 which rotates around pivot 47 inducing movement to H-link 48 around pivot pins 49, 52 thereby rotating latch element 50 out of holding notch 53. This release position is shown in the view of FIG. 6.

The closure member 40 is moved by the spring 54 until movement of the closure member is stopped by transverse angle member 56. The closure member overrides a locking pin assembly, shown generally as 57, which then engages locking catch 42. The locking pin assembly includes a locking head 58 which is urged against the bottom of the horizontal arm of the transverse angle 56. An annular flange element 59 is fixed towards the end of the pin shank 60, and said pin shank passes through an opening in the horizontal arm (not identified by numeral) and into a chamber 62 formed within the horizontal arm. A spring 64 is positioned in the chamber between the annular flange 59 and the horizontal arm. The compressed spring has a final turn urged against the annular flange which thereby biases the shank above the horizontal arm of the transverse angle. The tip of the shank is rounded or formed on a radius so that it may be overridden by the closure member to depress the pin until the locking catch 32 is registered with the pin. The pin shank then enters the locking catch and prevents the closure member from being moved to unseal the coin entry by anyone other than an authorized user. Opening the door 26 of the coin box allows the authorized user to pull the locking pinhead downwardly towards the bottom of the coin box to thereby release the locking pin assembly and allow the closure member to be repositioned against compressed spring 54. The closure is held in open position by the latch assembly in operative position.

Figure 10:
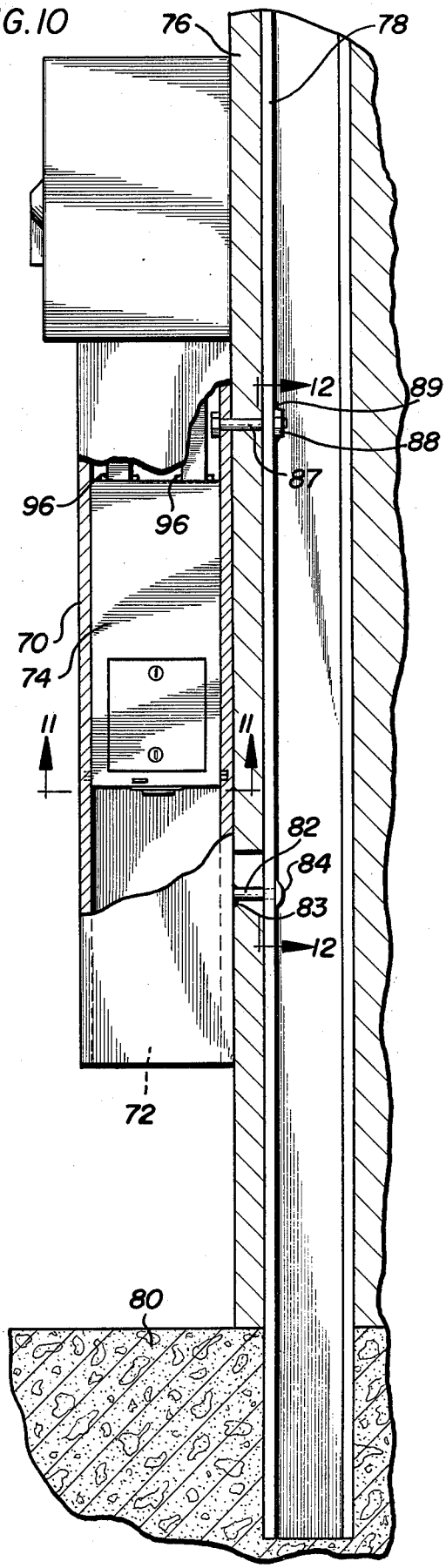
FIG. 10 is a side elevational view, partly in section, showing an alternative form for anchoring the post above ground level.
Figure 11:
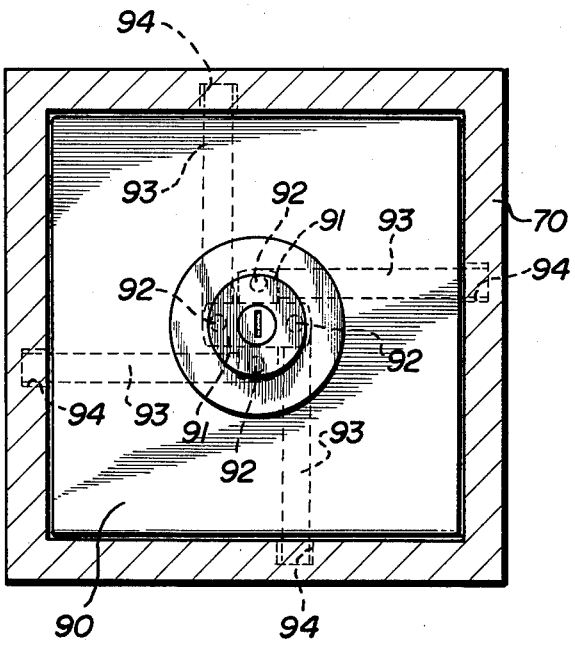
FIG. 11 is a sectional view taken along line 11—11 of FIG. 10, but on an enlarged scale, and showing an alternative form for supporting the coin box entirely within the post.
Figure 12:
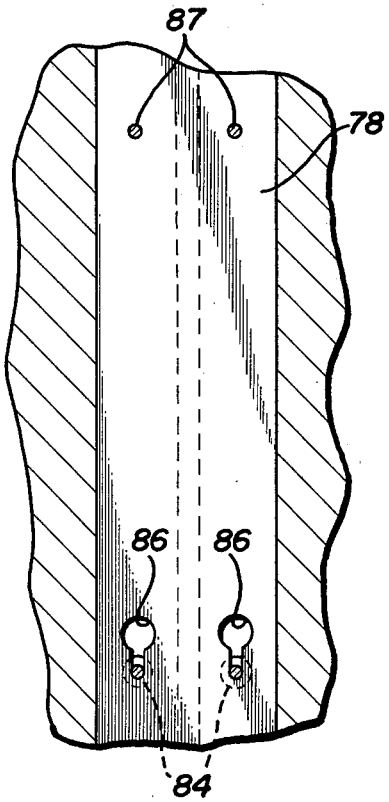
FIG. 12 is a portional view taken along line 12—12 of FIG. 11.

The alternative embodiment shown in FIGS. 10-12 include a wall mounted post 70 with an open bottom end 72 through which coin box 74 is removed and inserted. The coin box 74 has an enlarged volume to collect a greater number of coins and thereby require less frequent removal and emptying. The coin box is elongated or enlarged along its vertical axis.

The post 70 is shown anchored to wall 76 and flange 78 of an I-beam which is further shown as being set in a concrete bed 80 at its bottom end. The bottom opening 72 of the post is therefore above the ground level as defined by the concrete bed 80, thereby still requiring a bottom-up movement by a user to reach the coin box 74.

The anchoring means are shown as including a stub bolt 82 secured to a sidewall of the post by welds 83. The head 84 of the bolt is passed through an enlarged portion of keyhole slot 86 in the flange 78 of the I-beam. The shank of the bolt then drops into the smaller portion of the keyhole slot, the oversize head 84 holding the post above ground level. A pair of such stub bolts can be used and the heads 84 are indicated in dotted line as being on the other side of the flange 78 in the view of FIG. 12.

A pair of upper bolts 87 are also shown, and such bolts pass through aligned passageways in the sidewall of the post and the flange of the I-beam, the passageway in the sidewall being only shown and neither being identified by a numeral. The bolts are tightened by nuts, one of which is shown at 88, to further secure the post to the wall 76 and the flange 78 of the I-beam. The nut may be further secured to the flange 78 by welds 89.

The coin box 74 is provided with cooperating locking and support members disposed inside the box along the bottom wall 90. The locking member is a cruciform element having crossed arms 91. The opposite ends of the arms are connected by pivots 92 to support bars 93 which are actuated to move along linear paths when the cruciform locking element is rotated. The linear travel of the support bars 93 engage and disengage the locking slots 94 on the interior sidewalls of the post. The locking element as illustrated in the view of FIG. 11 is locked when rotated clockwise by a key so that the support bars move in their linear path to engage the locking slots. The locking element is unlocked with a key by rotating the locking element counterclockwise to disengage the support bars from the locking slots. Stops 96 may be fixed to the coin chutes so that the support bars 93 and the locking slots 94 are aligned when the box is raised against such stops.

It will be seen that separating the coin vault and the coin operated device serves to protect the device because wouldbe thieves will attack the coin vault and not the device. This leads to important economic savings in that valuable devices, such as vacuum appliances or vending machines, can be protected against costly damage.

The various forms which have been disclosed provide that a hollow post is anchored to a support, whether said support is at or about ground level. A port at the bottom of the post can be formed in a side wall or be coincidental with the bottom opening of the post. In both embodiments a user must execute bottom-up movements to withdraw the support member for the coin box and remove the coin box through the bottom port. The lock which must be opened is inside the post and the support member for the coin box is within the post at least insofar as it supports the coin box. FIGS. 1–4 shows such support member as being manipulated from outside the post to assume supporting and nonsupporting positions relative to the coin box; and the views of FIGS. 10–12 indicate a support member which is manipulated within the post to assume its supporting and unsupporting positions relative to the coin box.

The post shown anchored to a support above ground level in the views of FIGS. 10–12 is used to advantage even where free access is allowed to users. For example, such a coin vault can be securely anchored to a wall of an automatic car wash station. In fact a common wall to two stations can support coin vaults on opposite sides of the same wall, utilizing common anchoring means such as the I-beam which has been shown. Other applications will occur to practitioners.

The claims of the invention are now presented and the terms of such claims may be further understood by reference to the language of the preceeding specification and the views of the drawings.

What is claimed is:

1. A coin vault assembly for coin operated devices, including an upstanding hollow post anchored to a support, a coin receiving mechanism mounted to the top of the post and electrical conductor means for connecting a device to said coin mechanism for programmed operation, a port at the bottom of the post, a removable coin box within the post, said coin box having continuous sidewalls, a top and a bottom, an opening in the top of said coin box, a coin chute extending from said coin mechanism and communicating with the opening in said top of the coin box, a support means associated with the bottom of the coin box, a locking member for said support member, and means in a sidewall of the post to hold the support member when the locking member is locked and to release the support member when the locking member is unlocked, whereby said support member holds the coin box above the port thereby requiring the user to unlock the locking member by manual manipulation through the port so that the said support member may be withdrawn from said holding means and the coin box may be dropped for removal from the post through said port.

2. A coin vault assembly which includes the features of claim 1 wherein said port in a sidewall at the bottom of the post, and said post is anchored to a ground level support.

3. A coin vault assembly which includes the features of claim 2 wherein said ground level support is a bed of concrete.

4. A coin vault assembly which includes the features of claim 1 wherein said post is anchored to an upright support.

5. A coin vault assembly which includes the features of claim 4 wherein said port at the bottom of the post is above ground level.

6. A coin vault assembly which includes the features of claim 5 wherein said port is the bottom open end of said post.

7. A coin vault assembly which includes the features of claim 1 wherein the means in the sidewall which holds said support member is a mounting aperture, and said support member has an oversized handle portion outside the sidewall of the post and a shank portion passing through the mounting aperture to the interior of the post, said handle and shank portion being formed from heavy duty steel to discourage attempts to break off said handle, and said locking member being a lock, the shackle whereof engages a mounting passageway in the shank portion of the support member.

8. A coin vault assembly which includes the features of claim 7 wherein said mounting aperture in the sidewall has tapered sides and wherein said handle has complementary tapered sidewall portions so that said handle is wedged and recessed in said mounting aperture in oriented, non-rotational position.

9. A coin vault assembly which includes the features of claim 8 wherein the handle on the outside of the post is surrounded by a steel fence to prevent cutting action against the handle along a plane which is generally parallel to a sidewall of the post.

10. A coin vault assembly which includes the features of claim 1 wherein said support and locking members are mounted to the bottom of said coin box, said means in the sidewall to hold said support member being a locking slot, and means connecting said locking member and support members so that the locking action moves the support member to engage said locking slot and unlocking action moves said support member to disengage said locking slot.

11. A coin vault assembly which includes the features of claim 10 wherein said locking member is rotated in one direction when locked and rotated in the opposite direction when unlocked, and a plurality of support members are pivoted to said locking member so that rotation of the locking member imparts linear movement to the support members to engage and disengage a locking slot in each of different sidewalls of the post.

12. A coin vault assembly which includes the features of claim 5 wherein the upright support to which said post is anchored is a wall which includes a sturdy beam, and bolt fasteners securing a sidewall of said post to said sturdy beam.

13. A coin vault assembly which includes the features of claim 1 wherein said coin box has interior closure means which operate to close the opening in the top upon separating the coin box from said coin chute, said means including track means mounted to the underside of the top for guiding a movable closure, means urging closure member to a stop member, a biased locking element at said stop member displaceable by said closure member engageable by said displaced and biased locking element, said closure member being held against said urging means by the coin chute in the top opening of the coin box, and said urging means moving said closure member when the coin box is lowered free of the coin chute in said top opening.

14. A coin vault assembly which includes the features of claim 13 which further includes a latch mechanism inside the coin box, said mechanism having a latch element engaging a locking notch in the closure member to hold said closure member open against said urging means, said latching element connected by linking means to a release latch which is tripped by the coin chute when the coin box is positioned in place, thereby disengaging said latch element.

15. A coin vault assembly which includes the features of claim 1 wherein the distance of the supported coin box above the port is such as to require a user to insert substantially the entire length of a forearm before reaching the bottom of the coin box.

* * * * *